United States Patent [19]

Manley

[11] 4,256,409

[45] Mar. 17, 1981

[54] IMPLEMENT FOR CLEANING THE FEET

[76] Inventor: Douglas C. Manley, 16045 SE. Clatsop, Portland, Oreg. 97236

[21] Appl. No.: 44,527

[22] Filed: Jun. 1, 1979

[51] Int. Cl.[3] ..... A46B 11/02

[52] U.S. Cl. ..... 401/24; 401/6; 401/183; 401/196; 401/287

[58] Field of Search ..... 401/6, 9, 16, 22, 23, 401/24, 40, 41, 183–186, 196, 203, 204, 268, 283, 284, 286, 287, 289; 128/232, 267, 269; 132/74.5

[56] References Cited

U.S. PATENT DOCUMENTS

| | | | |
|---|---|---|---|
| 222,031 | 11/1879 | Gerike | 401/24 |
| 520,241 | 5/1894 | Ott | 401/183 |
| 907,850 | 12/1908 | Mountford | 401/184 |
| 950,612 | 3/1910 | Danbeck et al. | 401/289 |
| 1,888,061 | 11/1932 | Allen | 401/289 |
| 1,939,344 | 12/1933 | Garland | 401/28 |
| 1,965,344 | 7/1934 | Josinsky | 401/28 |
| 2,290,378 | 7/1942 | Motto | 401/28 |
| 2,316,326 | 4/1943 | Garin | 401/203 |
| 2,756,449 | 7/1956 | Dewey | 401/289 X |
| 2,936,471 | 5/1960 | Coleman | 401/186 |
| 2,976,560 | 3/1961 | Turner | 401/186 |
| 3,128,493 | 4/1964 | Paul | 401/184 |
| 3,519,364 | 7/1970 | Truhan | 401/196 X |
| 4,078,865 | 3/1978 | Moser | 401/23 |
| 4,134,697 | 1/1979 | Sparr, Sr. | 401/276 |

*Primary Examiner*—Steven A. Bratlie
*Attorney, Agent, or Firm*—Eugene M. Eckelman

[57] ABSTRACT

An elongated hollow body member is arranged to receive a cleaning solution and has a cleaning head on the lower end thereof. The cleaning solution is arranged to be admitted to portions of the cleaning head by squeezing a flexible portion of the hollow body member. The cleaning head comprises an axial shank-like extension on the lower end of the body member and includes a soft resilient covering on one portion thereof and a brush on another portion thereof, such cleaning portions being of a diameter which allow them to be moved between the toes for cleaning such areas. The cleaning head also has a cross brush on the lower end of the axial extension for cleaning surface portions of the feet.

3 Claims, 5 Drawing Figures

IMPLEMENT FOR CLEANING THE FEET

FIELD OF THE INVENTION

This invention relates to a new and useful implement for cleaning the feet.

SUMMARY OF THE INVENTION

According to the present invention and forming a primary objective thereof, an implement is provided which is arranged for use in cleaning the feet and is designed for use by persons who otherwise cannot conveniently reach their feet while in the shower or tub such as obese persons, persons with stiff or injured backs, pregnant women, or others.

In carrying out such objective, the implement includes an elongated hollow body member adapted to hold a supply of cleaning solution. A cleaning head is mounted on the lower end of the body member and comprises one or more small diameter shank-like extensions each supporting a sponge portion and a brush portion arranged to be moved between the toes for cleaning such areas. The hollow body member has a flexible portion which can be squeezed to feed the cleaning solution to the cleaning head. The cleaning head also has a cross brush for cleaning surface areas of the feet.

The invention will be better understood and additional objects and advantages will become apparent from the following description taken in connection with the accompanying drawings.

DETAILED DESCRIPTION OF PREFERRED EMBODIMENTS

Figure 1:
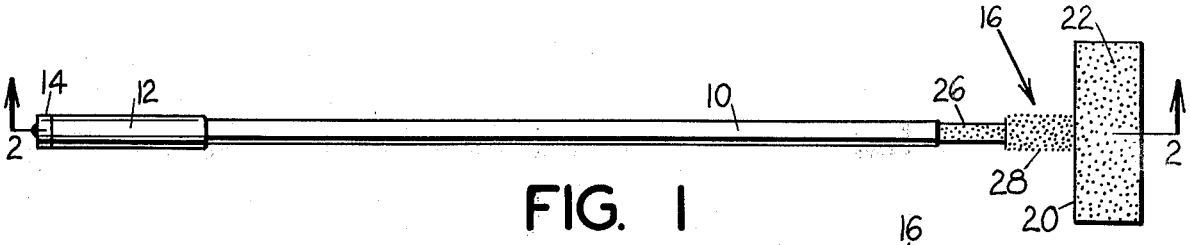
FIG. 1 is an elevational view of a first embodiment of implement embodying features of the present invention.
Figure 2:
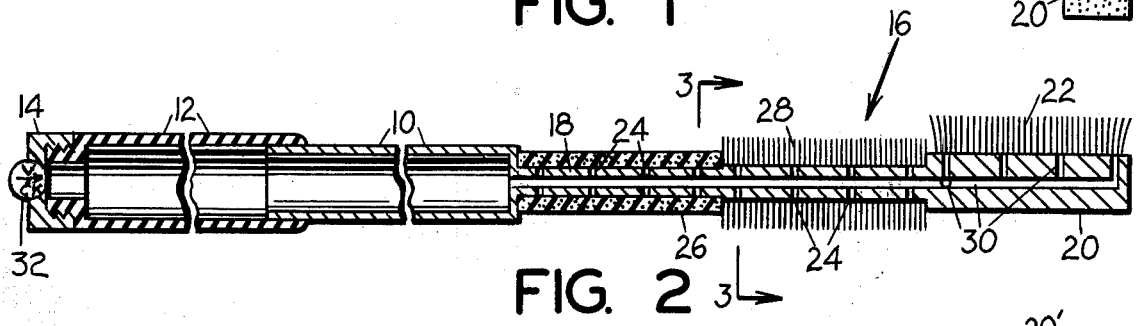
FIG. 2 is an enlarged, foreshortened sectional view taken on the line 2—2 of FIG. 1.
Figure 3:
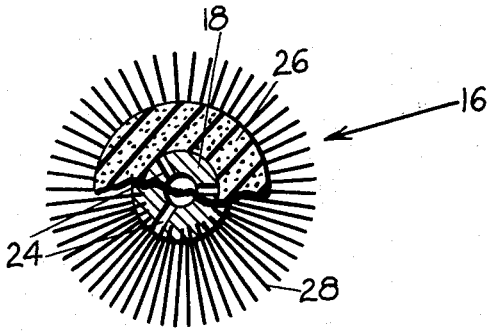
FIG. 3 is an enlarged cross sectional view, partly broken away and taken on the line 3—3 of FIG. 2.

With particular reference first to FIGS. 1-3 a first embodiment of the invention includes an elongated substantially rigid hollow body member 10 having an upper flexible portion 12 with a top removable cap 14. Extension 12 is also hollow to communicate with the body member whereby the body member and portion 12 are to receive a liquid cleaning solution.

The lower end of body member 10 carries a cleaning head 16 comprising a rigid rod-like extension 18 secured integrally to the body member and supporting a cross brush 20 at its lower end. This brush has the bristle portion 22 thereof extending laterally.

The rod-like extension 18 is hollow and has a plurality of radial ports 24 through which cleaning solution from the handle is arranged to be discharged by squeezing flexible portion 12.

Extension 18 has a cylindrical covering 26 of resilient scrubbing or washing material such as sponge on a portion of its length and has a cylindrical brush 28 on another portion of its length. Sponge 26 and brush 28 are of a cross sectional dimension arranged to be moved between the toes for cleaning such areas. Ports 24 are also provided in the extension 18 in the area of the brush 28.

In the use of the present implement, the body member 10 is filled with a cleaning solution such as a liquid soap, which may be medicated if desired, and persons using such implement can, without bending over, readily clean surfaces of the feet by using the brush 20 and clean the areas between the toes by using the sponge 26 and/or the brush 28. If it is desired that soap be applied to the areas 26 and 28, a squeezing pressure is applied to the flexible extension 12.

Soap can also be supplied to the brush 20 through the extension 18 in the same manner that it is applied to sponge 26 and brush 28. That is, the extension 18 is secured to the brush 20 so that such hollow extension communicates with ports and passageways 30 in the base of the brush which lead into the bristle area and supply cleaning solution thereto upon squeezing the upper extension 12. Ports and passageways 30 may be omitted, however, since soap can be easily applied to the bristle portion 22 by rubbing it on a bar of soap. A check valve 32 is provided in the cap 14 for proper entrance of air.

Figure 4:
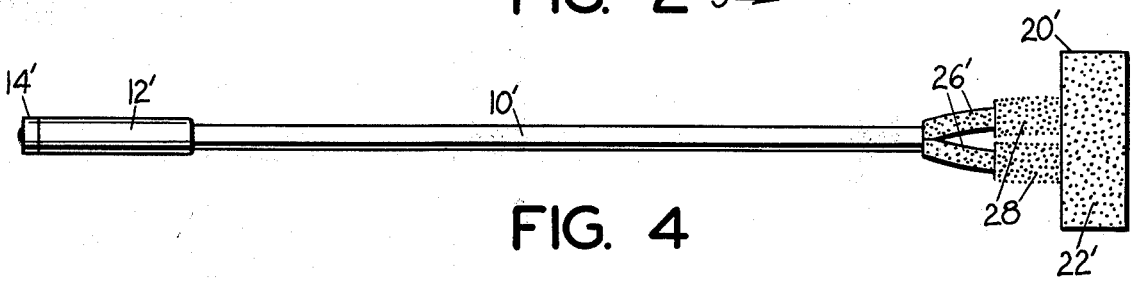
FIG. 4 is an elevational view of a second embodiment of the invention.
Figure 5:
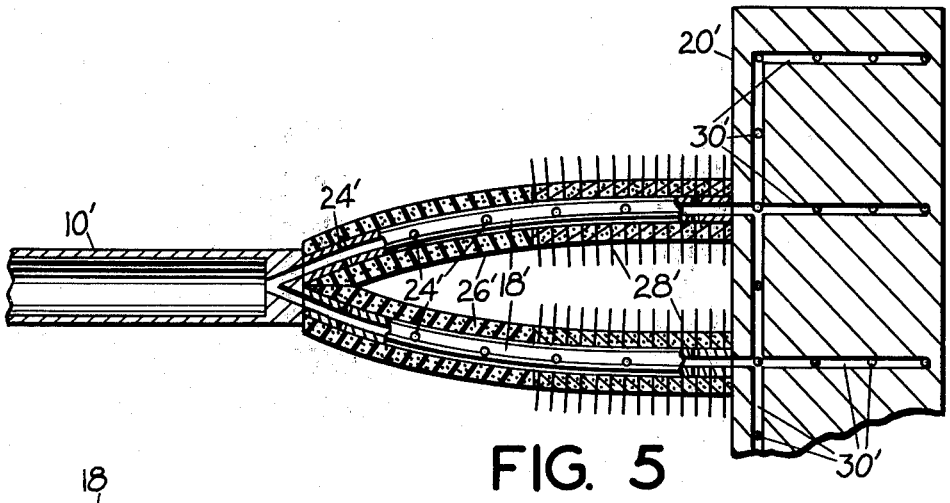
FIG. 5 is an enlarged fragmentary sectional view of the FIG. 4 embodiment showing internal structure.

FIGS. 4 and 5 show a second embodiment of the invention. The body member 10' is of identical structure to the embodiment of FIG. 1, employing the flexible portion 12' and cap 14'. This embodiment also has the bottom, laterally directed brush 20'. In this modified structure, two rod-like extensions 18' instead of one lead integrally from the bottom end of body member 10' and provide a two point support for the brush 20'. The extensions 18' similarly have outlet ports 24' and cleaning portions 26' and 28' consisting respectively of a round sponge portion and a round brush. Extensions 18' bow out from each other a slight amount in an arrangement allowing the two portions to straddle a toe and thus accomplish a cleaning function in two areas at the same time. Ports and passageways 30' may or may not be provided in the brush 20'.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. An implement for cleaning the feet comprising (a) an elongated hollow body member having upper and lower ends, (b) said body member being arranged to receive a cleaning solution, (c) a rod-like extension on the lower end of said body member having a resilient exterior cylindrical cleaning portion of a cross sectional dimension allowing it to be worked between the toes for cleaning such areas, (d) said rod-like extension also including a cylindrical brush having radial bristles, (e) said brush being in axial alignment with said cylindrical cleaning portion and also being of a cross sectional dimension allowing it to be worked between the toes, (f) passageway means in said rod-like extension communicating with said hollow body member and leading to said resilient exterior cleaning portion and to said cylindrical brush whereby cleaning solution can be fed from said body member to said resilient exterior cleaning portion and to said cylindrical brush, (g) said body member having a flexible portion which when squeezed inwardly is arranged to force cleaning solution through said passageway means to said resilient exterior cleaning portion and to said cylindrical brush, (h) and a cross brush secured on the lower end of said rod-like extension for cleaning surfaces of the feet.

2. The implement of claim 1 wherein said passageway means also extends into said cross brush to feed cleaning solution to its bristles upon squeezing said flexible portion.

3. An implement for cleaning the feet comprising (a) an elongated hollow body member having upper and lower ends, (b) said body member being arranged to receive a cleaning solution, (c) a pair of cylindrical rod-like extensions on the lower end of said body member each having a resilient exterior cleaning portion disposed in spaced relation and being of a cross sectional dimension allowing it to receive a person's toe therebetween for simultaneously cleaning side areas of a toe, (d) said cylindrical rod-like extensions each having a resilient cleaning portion and a brush portion in axial alignment therewith having radial bristles, (e) passageway means in each said rod-like extension communicating with said hollow body member and leading to said resilient cleaning portion and to said brush portion whereby cleaning solution can be fed from said body member to said resilient cleaning portion and to said brush portion, (f) said body member having a flexible portion which when squeezed inwardly is arranged to force cleaning solution through said passageway means to said resilient exterior cleaning portion and said brush portion, (g) and a cross brush secured on the lower end of said rod-like extensions for cleaning surfaces of the feet, (h) said passageway means also extending into said cross brush to also feed cleaning solution to its bristles upon squeezing said flexible portion.

* * * * *